US005104453A

United States Patent [19]

Kappler

[11] Patent Number: 5,104,453

[45] Date of Patent: Apr. 14, 1992

[54] METHOD AND APPARATUS FOR ELIMINATING LIQUID COMPONENTS AND FINE-GRAINED COMPONENTS FROM A SUGAR SUSPENSION

[75] Inventor: Gerhard W. Kappler, Bad Liebenzell, Fed. Rep. of Germany

[73] Assignee: Laboratorium Prof. Dr. Rudolph Berthold, Wildbad, Fed. Rep. of Germany

[21] Appl. No.: 373,518

[22] Filed: Jun. 30, 1989

[30] Foreign Application Priority Data

Jul. 1, 1988 [DE] Fed. Rep. of Germany ..... 3822225

[51] Int. Cl.[5] ..... C13D 1/00

[52] U.S. Cl. ..... 127/45; 127/56; 127/63; 210/96.1; 210/106

[58] Field of Search ..... 127/56, 63; 210/106, 210/96.1, 739, 740

[56] References Cited

U.S. PATENT DOCUMENTS 4,257,879 3/1981 Bogenschneider et al. ..... 209/12

OTHER PUBLICATIONS

*Cane Sugar Handbook*, Meade-Chen, 10th ed., John Wiley & Sons, 1977, pp. 336–338.

*Primary Examiner*—Theodore Morris
*Assistant Examiner*—P. L. Hailey
*Attorney, Agent, or Firm*—Spensley Horn Jubas & Lubitz

[57] ABSTRACT

In a method and apparatus for eliminating liquid components and fine-grained components from a sugar suspension, control variables for controlling the centrifuge are obtained from a measurement of the quantity of material per unit of surface area in the filter cake formed in the centrifuge during the centrifuging process. In particular, a radiometric measurement can be used for this purpose. From the time course of the measurements obtained, relationships with the physical composition of the filter cake at the instant of measurement are derived and used to adjust process control variables, such as the quantity of water to be added and the length of the washing phase. The control of such a process can be made fully automatic, with optical quality, using a single continuous measurement.

10 Claims, 2 Drawing Sheets

METHOD AND APPARATUS FOR ELIMINATING LIQUID COMPONENTS AND FINE-GRAINED COMPONENTS FROM A SUGAR SUSPENSION

BACKGROUND OF THE INVENTION

The invention relates to a method for eliminating liquid components and fine-grained components from a sugar suspension, in which a certain fill quantity of the sugar suspension is spun in a centrifuge, with a certain quantity of water and/or steam added intermittently for a certain period of time, as well as to an apparatus for performing the method.

Such a method is used in the sugar industry particularly for removing the liquid component from the sugar suspension (also known as crystal suspension or magma) obtained in boiler apparatus. Centrifuges are used for this purpose, and the separation takes place in two phases:

After filling of the centrifuge with a certain predetermined quantity of sugar suspension, the spinning process begins, in which a sugar solution of lowest purity ("green runoff"), which contains all the substances incapable of crystallization, such as ash components, cellulose and the like, is precipitated out. This "green runoff" is used for further processing of the solution having the next lower purity;

Once this "green runoff" has been separated out, the so-called washing phase follows; that is, washing water is sprayed from nozzles onto the filter cake deposited at the circumference of the centrifuge. During this washing phase, any syrup residues still adhering to the sugar crystals are intended to be washed out; at the same time, the fine-grained components contained in the solution are dissolved and likewise washed out. Otherwise, the fine-grained components could cause plugging when the crystals are later filtered out with sieves. The liquid separated out during this phase is called the "washing runoff".

To increase the washing action it is also possible, instead of or in addition to spraying with water, to expose the filter cake to steam; in both cases, washing must be performed until such time as the syrup residues have been washed away from the crystal surface as completely as possible and throughout the entire thickness of the filter cake, i.e. the filter cake must be "washed through". On the other hand, however, prolonging of the washing process results in an unnecessary dissolving of additional sugar, which would have to be subsequently recrystallized, a process that again requires thermal energy.

The fact that the composition of the crystal suspension may undergo major fluctuations under some circumstances, particularly in terms of the crystal sizes and especially the fine-grained components, makes it impossible to arrive at fixed values for optimizing the centrifuging and washing process, although, as explained above, such fixed values would, on the one hand, assure the completest possible washing and, on the other hand, would prevent unnecessary prolongation of the process, with the attendant poorer overall results in terms of cycle time and energy consumption.

If the syrup components in the green runoff phase drain off quickly, then it can be concluded that the fine-grained component is proportionately small, and consequently the water quantity in the washing phase can also be kept relatively small. If the outflow of syrup components in the green runoff phase is relatively slow, then it can be concluded that the fine-grained component is proportionately very large and the permeability of the filter cake is low; consequently the water quantity during the washing phase must be increased, or the fill quantity of the centrifuge must be reduced in the next cycle. Otherwise, because of the reduced permeability of the filter cake, a certain backup of fluid can occur in various layers, and this in turn again leads to an undesirable partial dissolution of crystals.

This makes it clear that a plurality of parameters, such as the fill quantity of the centrifuge having the crystal suspension, the quantity of water and/or water vapor used for washing, the beginning and end of the centrifuging process, and the beginning and end of the washing process determine the quality of the outcome of the method both individually, and in their functional dependency on one another.

Previous attempts to define these process parameters as optimally as possible, in the sense described above, have been limited to monitoring the various end products, that is, the remaining crystals or the washing runoff, by taking laboratory samples, for instance by refraction measurements. Such random sampling is very time-consuming and labor-intensive; the results are not available immediately; and the sampling is of necessity highly inaccurate.

Hence this known approach to determining the process parameters can merely serve to prevent the gravest control errors.

SUMMARY OF THE INVENTION

It is accordingly an object of the invention to effect a precise determination of the aforementioned control variables.

Another object of the invention is to effect such a determination in a simple manner.

A more specific object of the invention is to optimize such a process with a view to the quality of the sugar obtained.

A further specific object of the invention is to minimize the energy expended in such a process.

The above and other objects are attained by determining the control variables for the process, in particular for specifying the fill quantities, the washing duration and the centrifuging duration, at least in part by intermittent or continuous measurement of the mass per unit area, i.e. perhaps more precisely, the product of the density and the radial thickness, of the filter cake deposited at the circumference of the centrifuge during the centrifuging operation.

Specifically, these objects are achieved, in a process for eliminating liquid components and fine-grained components from a sugar suspension, which process includes centrifuging a selected fill quantity of sugar suspension in a centrifuge having a peripheral wall to deposit on the wall an annular filter cake, and then washing the filter cake with a selected quantity of water and/or water vapor for a selected period of time, by the improvement comprising: effecting measurements of the quantity of material in the filter cake per unit surface area of the cake during the course of the centrifuging step; and controlling at least one parameter of the process on the basis of the measurements obtained.

The invention is thus based on recognition that the above-described dynamic processes in the composition of the filter cake, which take place from the addition of water, on the one hand, during the washing phase, or by the runoff of the green runoff and washing runoff, on the other hand, are characteristically expressed by the density per unit of surface area of the filter cake. Monitoring the mass per unit area during the entire process, in particular by continuous measurement, furnishes a curve having segments and slope values that are characteristic for the particular "state" of the filter cake and thus for the elimination thus far, i.e. at that time in the measurement, of the applicable substances during the green runoff or washing runoff.

However, the method according to the invention makes the current information available at every instant in the process and can be used directly for controlling the process. For example, the aforementioned possible rapid outflow of the syrup components in the green runoff phase means that the slope of the surface density curve is not steep; this can be used directly for adjusting the quantity of water required subsequently in the washing phase to a low value.

A large fine-grained component and low permeability of the filter cake will lead to a less steep slope of the surface density curve during the washing phase, so that the water quantity might perhaps have to be increased during the washing phase, or the predetermined fill quantity for the centrifuge would have to be reduced for the next cycle.

To distinguish between these two possibilities, it is recommended that the surface density curve of the filter cake be monitored in the washing phase, because from this curve conclusions can be drawn as to the permeability of the filter cake, and a liquid backup in the filter cake can possibly be sensed, which also leads to the partial dissolution of crystals (as explained above) and consequently means it is appropriate to reduce the fill quantity in the next cycle.

From these examples it is clear that in a situation with particular specified equipment, for instance with a specified centrifuge size, rate of rotation, and so forth, the various dynamic processes become "visible" from the form of the surface density curve and thus can be optimally controlled as a direct reaction thereto by means of suitably selecting the control variables.

According to a preferred embodiment of the invention, the measurement of density can be effected radiometrically; that is, a radioactive source is disposed on the outer circumference of the centrifuge to irradiate the filter cake; the radiation used, for instance gamma radiation, strikes a detector disposed inside the centrifuge or on the opposite side of the centrifuge. The absorption of this radiation by the filter cake then provides an immediate indication of the mass of the filter cake per unit area; that is, the density of the filter cake is represented directly by the counting rate supplied by the detector to a suitable evaluation circuit. This counting rate can be readily displayed graphically "simultaneously", i.e. in real time, with the process unfolding at that time, and enables the aforementioned obtaining of the parameters critical to control of the process.

Optionally, this detection can be automated, for instance by using suitable components in an evaluation circuit to differentiate the curve shape for obtaining slope values and optionally comparing it with predetermined threshold values (obtained from calibration measurements), whereupon the appropriate control signals are then supplied to the corresponding components of the centrifuge, such as the motor for the centrifuge shaft or the pump for supplying the water nozzles.

Once such values have been obtained experimentally by suitable calibration measurements, then the entire process can consequently unfold automatically.

An exemplary embodiment of an apparatus for performing the method according to the invention will now be described in detail, in conjunction with the drawings.

DESCRIPTION OF THE PREFERRED EMBODIMENTS

Figure 1:
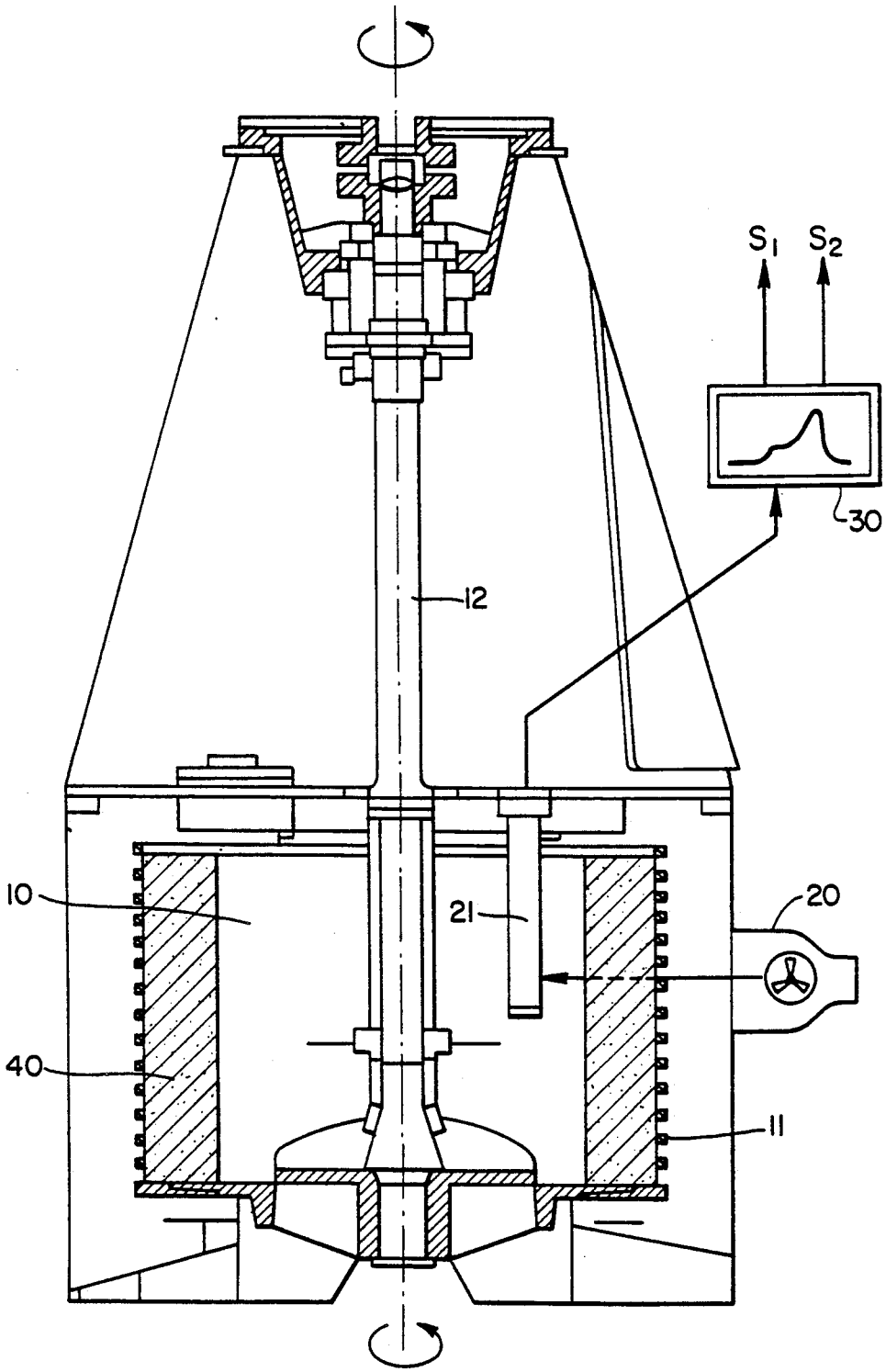
FIG. 1 is a simplified elevational, cross-sectional view showing the basic structure of a centrifuge for treating a sugar suspension in accordance with the invention.

Figure shows a centrifuge having a drum 10 supported by a shaft 12 for rotation about a vertical axis by means of a motor (not shown). The top of drum 10 is open so that a sugar suspension can be fed in to the drum. During rotation of drum 10, as a result of the centrifugal force created, solid components of the suspension are pressed outwardly against the outer wall, or jacket, 11 of drum 10, where they form an annular filter cake 40 of largely constant thickness.

A radioactive source 20, for example a gamma emitter, is disposed outside of drum 10 so that the radiation produced by source 20 passes through filter cake 40 in the radial direction of the drum and toward the interior of drum 10 so as to impinge on an associated detector 21, which consequently produces a reading indicative of the absorption of radiation by filter cake 40. The absorption by filter cake 40 depends on the filter cake thickness and on its various components during the centrifuging or washing phase; consequently the counting rate of detector 21 constitutes a direct indication of the mass per unit surface area of filter cake 40.

The output signal of detector 21 is supplied to a display and/or evaluation circuit 30 which can be constructed according to principles well known in the art. In circuit 30, based on threshold values or limit values, for instance obtained by means of calibration measurements, or curve patterns stored in memory, control signal signals S1 and S2 are obtained and are then supplied to control the motor of driving shaft 12 or the pump (not shown) for supplying the washing water to the centrifuge. The particular design of the evaluation circuit 30 can be accomplished in a known manner and with known components as can the particular design of the centrifuge, so that these need not be described in further detail here.

A typical implementation of the method according to the invention will now be explained with reference to FIG. 2, which illustrates in a qualitative manner, the variation in mass per unit area, F, as a function of time, t.

At time $t=0$, with the centrifuge rotating, drum 10 is filled with a crystal suspension, which is deposited as a cake 40 of increasing thickness on the inner surface of jacket 11 of drum 10. At the same time, green runoff flows out increasingly through the permeable jacket 11. The net result however, is that the filling of crystal suspension predominates, so that in the first centrifuge phase A (green runoff), the curve has a more or less steep rising slope. The process criterion $\Delta F/\Delta t$ (slope of the curve) depends on the behavior of filter cake 40 and the filling rate during the green runoff phase A, and can for instance also be utilized for controlling the fill level or determining the length of the ensuing washing phase B. The filling rate can, of course be determined by suitable, known measuring devices associated with the processing apparatus.

At time $T_1$, the filling process has ended and the washing phase B begins. Washing out of the syrup residues and fine-grained leads to a reduction in the in, the slope $\Delta F/\Delta t$, which now has a negative value, is a criterion for the outflow of the syrup components and thus the fine-grained component and can likewise be used for control, for instance for determining the final instant, or end point, $\tau$, of the washing phase B, $\tau$ being a time when $\Delta F/\Delta t$ is at least approximately equal to 0.

At time $T_2$, steam is added for the further intensification of the washing process whereupon a once again more pronounced dropoff of the mass per unit area F qualitatively results, until this density finally tends asymptotically to a value $F_0$, from which it can be recognized that the further addition of water or steam will no longer effectively rinse out undesirable ingredients, but at most would have the undesired effect of rinsing out additional sugar crystals.

Figure 2:
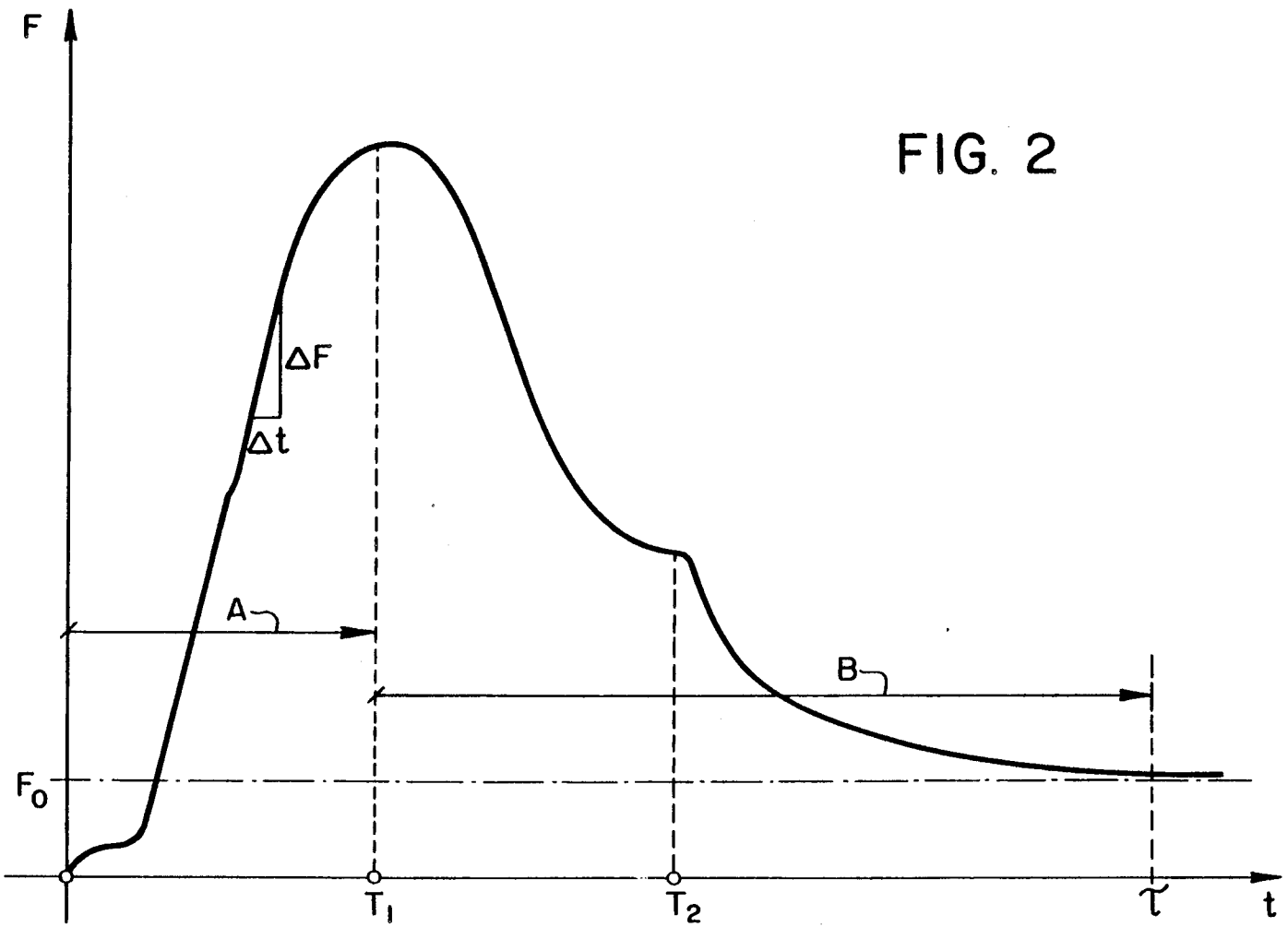
FIG. 2 is ,a diagram illustrating a typical curve of filter cake mass per unit of surface area as a function of time.

Referring to the qualitative diagram in FIG. 2, accordingly, it is for instance possible to develop simple relationships for control purposes.

The process can be controlled by essentially two quantities:

The actual filling degree at time $T_1$:

$$F_{akt}=F_{vor}+m_1*K_1+m_2*K_2+m_38K_3$$

and the actual washing period $T_{wakt}=\tau-T_2$:

$$T_{wakt}=T_{wvor}+m_2K_4+m_3K_5$$

The constants $K_1$ to $K_5$ have to be adjusted once to a specific unit while $m_1$, $m_2$and $m_3$ are the measured mean slopes according to FIG. 2 for the time intervals $0-T_1$, $T_1-T_2$ and $T_2-\tau$, respectively.

$F_{vor}$ and $T_{wvor}$ are preset values.

Time $T_2$ is defined by that moment the unit per unit area drops below an also preset value $F_w$ $F_{akt}$ and $T_{wakt}$ always have to be deduced from the preceding filling, washing and peeling off sequence.

This application relates to subject matter disclosed in Federal Republic of Germany Application P 38 22 225.6-41, filed on July 1, 1988, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalently of the claims are therefore intended to be embraced therein.

What is claimed is:

1. In a process for eliminating liquid components and fine-grained components from a sugar suspension, which process includes centrifuging a selected fill quantity of sugar suspension in a centrifuge having a peripheral wall to deposit on the wall an annular filter cake, and then washing the filter cake with a selected quantity of water and/or water vapor for a selected period of time, the improvement comprising: effecting measurements of the quantity of material in the filter cake per unit surface area of the cake during the course of the centrifuging step; and controlling at least one parameter of said process on the basis of the measurements obtained.

2. A method as defined in claim 1 wherein said step of controlling comprises controlling the fill quantity of sugar suspension.

3. A method as defined in claim 1 wherein said step of controlling comprises controlling the duration of said centrifuging step.

4. A method as defined in claim 1 wherein said step of effecting measurements is carried out by means of a radiation source which irradiates the filter cake and a detector disposed for detecting radiation passing from the source radially through the filter cake.

5. A method as defined in claim 1 wherein said step of controlling comprises adjusting the duration of said washing step as a function of the variation of the measured quantity of material in the filter cake per unit surface area of the cake with respect to time and the rate of delivery of sugar suspension to the centrifuge.

6. In apparatus for eliminating liquid components and fine-grained components from a sugar suspension, which apparatus includes means for centrifuging a selected fill quantity of sugar suspension in a centrifuge having a peripheral wall to deposit on the wall an annular filter cake, and means for washing the filter cake with a selected quantity of water and/or water vapor for a selected period of time, the improvement comprising: means disposed for effecting measurements of the quantity of material in the filter cake per unit surface area of the cake during the course of centrifuging; and means connected for controlling at least one parameter of the operation of said apparatus on the basis of the measurements obtained.

7. An apparatus as defined in claim 6 wherein said means for effecting measurements comprises a detector is disposed within said centrifuge.

8. An apparatus as defined in claim 7 wherein said means for effecting measurements comprises a detector is disposed outside said centrifuge.

9. In a process for eliminating liquid components and fine-grained components from a sugar suspension, which process includes centrifuging a selected fill quantity of sugar suspension in a centrifuge having a peripheral wall to deposit on the wall an annular filter cake, and then washing the filter cake with a selected quantity of water and/or water vapor for a selected period of time, the improvement comprising: effecting measurements of the quantity of material in the filter cake per unit surface area of the cake during the course of the centrifuging step; and controlling the duration of said washing step on the basis of the measurements obtained.

10. Apparatus as defined in claim 6 wherein said means for effecting measurements comprise a radiation source disposed for irradiating the filter cake in the radial direction of said centrifuge and a detector disposed for detecting radiation passing from the source radially through the filter cake.

* * * * *